US005461463A

United States Patent [19]

Iwama

[11] Patent Number: 5,461,463

[45] Date of Patent: Oct. 24, 1995

[54] ELECTROPHOTOGRAPHIC PRINTING MACHINE

[75] Inventor: Ryoichi Iwama, Kawasaki, Japan

[73] Assignee: Fujitsu Limited, Kawasaki, Japan

[21] Appl. No.: 289,230

[22] Filed: Aug. 12, 1994

[30] Foreign Application Priority Data

Sep. 16, 1993 [JP] Japan ..... 5-230445

[51] Int. Cl.[6] ..... G03G 15/00

[52] U.S. Cl. ..... 355/210; 355/271; 347/112

[58] Field of Search ..... 355/271, 272, 355/274, 210, 282, 285, 200; 347/112

[56] References Cited

U.S. PATENT DOCUMENTS

| | | | |
|---|---|---|---|
| 4,435,068 | 3/1984 | Landa . | |
| 4,845,519 | 7/1989 | Fuse | 347/112 |
| 5,032,873 | 7/1991 | Nishikawa | 355/271 |
| 5,282,012 | 1/1994 | Terada et al. | 355/210 X |

FOREIGN PATENT DOCUMENTS 59-192586 10/1984 Japan .

61-145649 9/1986 Japan .

*Primary Examiner*—R. L. Moses

*Attorney, Agent, or Firm*—Armstrong, Westerman, Hattori, McLeland and Naughton

[57] ABSTRACT

An electrophotographic printing machine includes a transporting part for transporting a recording medium, and a carriage movable in a first direction transverse to a second direction in which the recording medium is transported. The carriage includes a process unit for forming a latent image on an image carrier of a drum shape, and a fixing unit having a fixing member of a drum shape for thermally fixing a transferred image corresponding to the latent image on the recording medium. A transfer part, which is provided at a first side of the recording medium opposite to a second side thereof at which the carriage is located, transfers the latent image on the recording medium to thereby form the transferred image. A moving part moves the carriage in the first direction. A driving part controls the carriage so that the image carrier and the fixing member move at an identical relative paper feeding quantity in tune with a movement of the carriage by the moving part.

15 Claims, 9 Drawing Sheets

ELECTROPHOTOGRAPHIC PRINTING MACHINE

BACKGROUND OF THE INVENTION

1. Field of the Invention

The present invention generally relates to electrophotographic printing machines, and more particularly to a serial-type electrophotographic printing machine equipped with an image fixing device provided in a carriage performing printing.

Recently, electrophotographic printing machines having a carriage operating in an electrophotographic process have been developed due to demands for cost reduction and down-sizing of electrophotographic recording machines. Generally, such electrophotographic printing machines operate so that a carriage is moved on a transfer device in the direction traverse (perpendicular) to the direction in which paper is transported, and an image transferred on the paper is fixed by means of a roller-shaped fixing device disposed in the paper transporting direction. In order to facilitate down-sizing, an electrophotographic printing machine has been developed in which the fixing device is provided in the carriage. Nowadays, it has been required that such an electrophotographic printing machine operates safely and the size thereof is further reduced.

2. Description of the Prior Art

FIGS. 1A and 1B show the structure of a carriage provided in a conventional electrophotographic printing machine. More particularly, FIG. 1A is a plan view of the carriage and its peripheral parts, and FIG. 1B is a cross-sectional view taken along a line $I_B$—$I_B$ shown in FIG. 1A.

Referring to FIGS. 1A and 1B, a carriage 11 is made up of a process unit 12 and a fixing device 13, and is moved, by means of a driving motor (not shown for the sake of simplicity) above a transfer unit (print platen) 15 along guides 14*a* and 14*b* in the direction traverse to the paper transporting direction. On the either side of the carriage 11, transporting rollers 16*a* and 16*b* are arranged. A recording paper 17 is transported between the transfer unit 15 and the carriage 11 by means of the transporting rollers 16*a* and 16*b*.

The process unit 12 of the carriage 11 is equipped with an image carrier 21, which is rotated at a circumferential speed tuned with the movement of the carriage 11. The surface of the image carrier 21 is uniformly electrified by a charger 22. An electrostatic latent image is formed on the surface of the image carrier 21 by an exposure unit 23. The electrostatic image is visualized as a toner image by means of a developing roller 24. The toner image is transferred onto the recording paper 17 by means of the transfer unit 15 located at the side of the recording paper 17 opposite to the image carrier 21. The toner particles remaining on the image carrier 21 are scraped away by a cleaner 25.

The surface of the image carrier 21 which has been cleaned in the above way is electrified again by the charger 22, and the same process as described above is repeatedly performed. When the printing along a predetermined width is completed, the recording paper 17 is transported by a predetermined amount of movement by means of the transporting rollers 16*a* and 16*b*. The carriage 11 is returned to the predetermined position (home position), and performs the printing again. The home position is defined as a position which is located above the transfer unit 15 but is not located above the recording paper 17.

The image transferring by the transfer unit 15 is performed by applying a voltage across the image carrier 21 and the transfer unit 15, an electrically conductive member 15*b* such as an electrically conductive rubber sheet is placed on a base 15*a*.

The fixing unit 13 is equipped with a fixing roller 26 in which a heat source 27 such as a halogen lamp is provided. The fixing roller 26 is pressed against the recording paper 17. A silicon oil coating unit 28 is provided so as to be in contact with the fixing roller 26 in order to facilitate detachment of the toner particles from the fixing roller 26. The fixing roller 26 is preheated to a predetermined temperature by the heat source 27 before starting the printing operation. The temperature measured during printing is sensed by means of a temperature detector such as a thermistor (not shown for the sake of simplicity), and the fixing roller 26 is controlled based on the sensed temperature. That is, the fixing unit 13 is moved together with the process unit 12, and performs the fixing operation immediately after the image transfer by the process unit 12.

However, the conventional structure shown in FIGS. 1A and 1B has the following disadvantages.

As has been described previously, the toner image formed on the image carrier 21 is transferred to the recording paper 17 and immediately after this the transferred image is fixed thereon by the fixing roller 26, which is pressed against the recording paper 17. Hence, if the relative paper feeding quantity of the fixing roller 26 (which can be considered as if the fixing roller 26 is kept stationary) is not equal to that of the image carrier 21 (carriage 11), the recording paper 17 sandwiched between the transporting rollers 16*a* and 16*b* and fixed thereby may becomes a wavy state during the fixing process. Hence, it becomes possible to record images or characters on the correct positions of the recording paper 17.

In order to make the relative paper feeding quantity of the fixing roller 26 equal to that of the image carrier 21, a motor may be provided in the carriage 11. However, the use of the above motor prevents down-sizing of the carriage and increases the force of inertia due to an increase in the weight of the carriage 11. Hence, the use of the motor prevents the printing in the correct positions The image carrier 21 is needed to return to the home position (print starting position) after the printing operation on one line is completed while the image carrier is rotated clockwise. If the image carrier 21 is returned to the home position in a state in which the image carrier 21 is in contact with the recording paper 17. Hence, the image carrier 21 may be damaged and the printing quality may be degraded. Further, the above contact functions as a load on the returning movement of the image carrier 21, and prevents the high-speed returning movement thereof.

SUMMARY OF THE INVENTION

It is a general object of the present invention to provide a serial-type electrophotographic printing machine in which the above disadvantages are eliminated.

A more specific object of the present invention is to provide a down-sized, high-printing-quality, serial-type electrophotographic printing machine.

The above objects of the present invention are achieved by an electrophotographic printing machine comprising:

transporting means for transporting a recording medium;

a carriage movable in a first direction transverse to a second direction in which the recording medium is transported, the carriage comprising process means for forming a latent image on an image carrier of a drum shape, and fixing means having a fixing member of a drum shape for thermally fixing a transferred image corresponding to the latent image on the recording medium;

transfer means, provided at a first side of the recording medium opposite to a second side thereof at which the carriage is located, for transferring the latent image on the recording medium to thereby form the transferred image;

moving means for moving the carriage in the first direction; and driving means for controlling the carriage so that the image carrier and the fixing member move at an identical relative paper feeding quantity in tune with a movement of the carriage by the moving means.

The above objects of the present invention are also achieved by an electrophotographic printing machine comprising:

transporting means for transporting a recording medium;

a carriage movable in a first direction transverse to a second direction in which the recording medium is transported, the carriage comprising process means for forming a latent image on an image carrier of a drum shape, and fixing means having a fixing member of a drum shape for thermally fixing a transferred image corresponding to the latent image on the recording medium;

transfer means, provided at a first side of the recording medium opposite to a second side thereof at which the carriage is located, for transferring the latent image on the recording medium to thereby form the transferred image;

moving means for moving the carriage in the first direction; and refuge mechanism means for detaching the carriage from the recording medium when the carriage is returned to a home position.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1A:
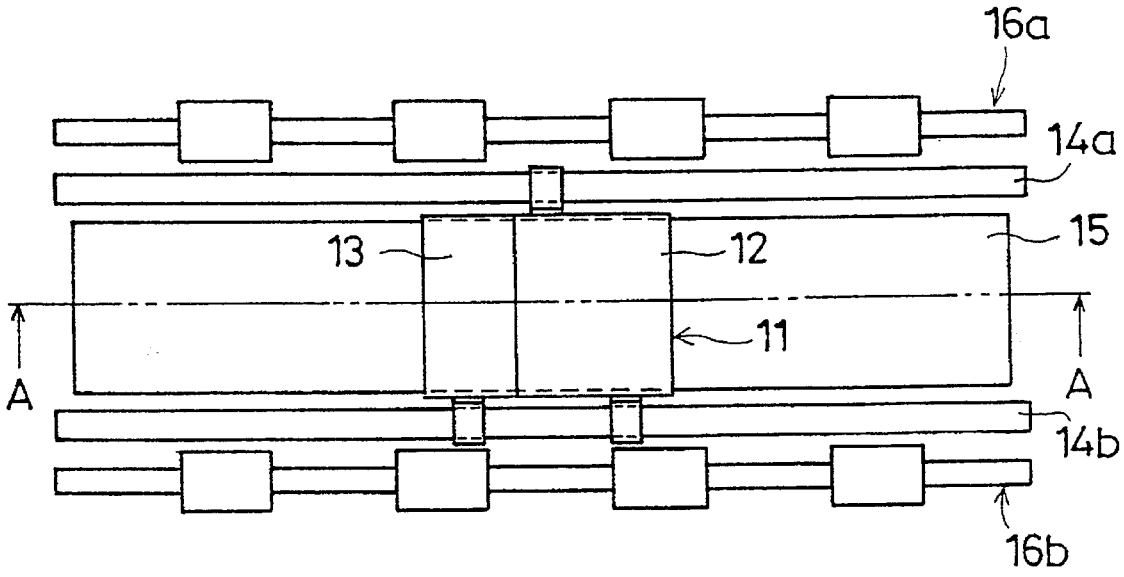
FIG. 1A PRIOR ART
FIG. 1A is a plan view of a carriage of a conventional electrophotographic printing machine.
Figure 1B:
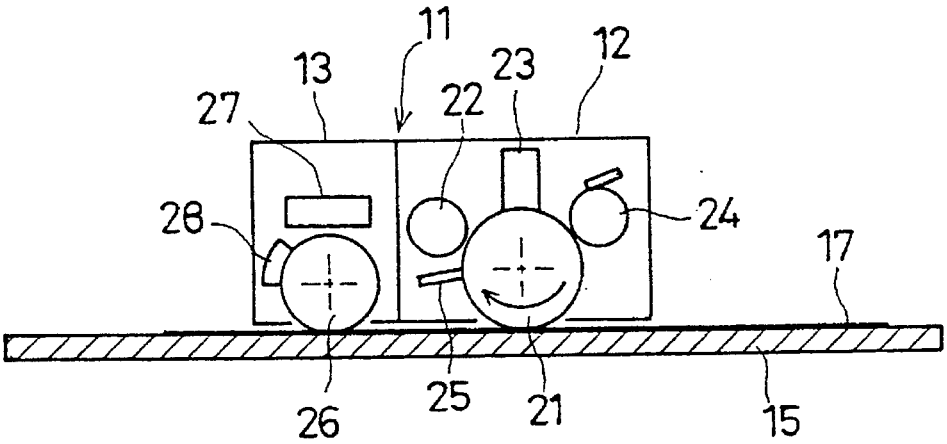
FIG. 1B PRIOR ART
FIG. 1B is a cross-sectional view of the carriage shown in FIG. 1A.

A description will now be given, with reference to FIG. 2, of a first embodiment of the present invention. A serial-type electrophotographic printing machine 31 includes a carriage 32 made up of a process unit 33 and a fixing unit 34. The carriage 32 is attached to a holding member 35 (which do not appear in FIG. 2; see FIGS. 4A and 4B). A guide member 35*a* is formed in the holding member 35, and a shaft 36 penetrates the guide member 35*a*. The carriage 32 is guided by the shaft 36, and is moved by means of a carrier motor 37 via a belt 37*a* in the main scanning direction transverse to the direction in which a recording paper 39 is transported.

Two transporting roller assemblies 38*a* and 38*b* are provided on either side of the shaft 36 so that the axial directions of these rollers are parallel to the axial direction of the shaft 36. The transporting roller assembly 38*a* includes a plurality of rollers $\mathbf{38}a_1$ arranged in a line and a transporting roller $\mathbf{38}a_2$. The recording paper 39 is sandwiched between the rollers $\mathbf{38}a_1$ and the roller $\mathbf{38}a_2$. Similarly, the transporting roller assembly 38*b* includes a plurality of rollers $\mathbf{38}b_1$ arranged in a line and a transporting roller $\mathbf{38}b_2$. The recording paper 39 is sandwiched between the rollers $\mathbf{38}b_1$ and the roller $\mathbf{38}b_2$. The rollers $\mathbf{38}a_2$ and $\mathbf{38}b_2$ are rotated in the same direction as each other by a transporting motor 40 via a belt 40*a*.

A transfer unit (print platen) 41 is disposed below the carriage 32. The transfer unit 41 includes a base made of aluminum or the like, and a heat-resistant electrically conductive material formed on the base. For example, the heat-resistant electrically conductive material is a silicon rubber sheet containing an electrically conductive material. The recording paper 39 is positioned between the transfer unit 41 and the carriage 32.

A rack 42 of a linear type is disposed in the vicinity of the transfer unit 41 and located between the shaft 36 and the transfer unit 41. The rack 42 engages a pinion gear of a recording drum, which will be described later. If the rack 42 and the pinion gear are provided at the side of the carriage 32 opposite to the side shown in FIG. 2, the carriage 32 may not be smoothly moved in the main scanning direction.

Figure 2:
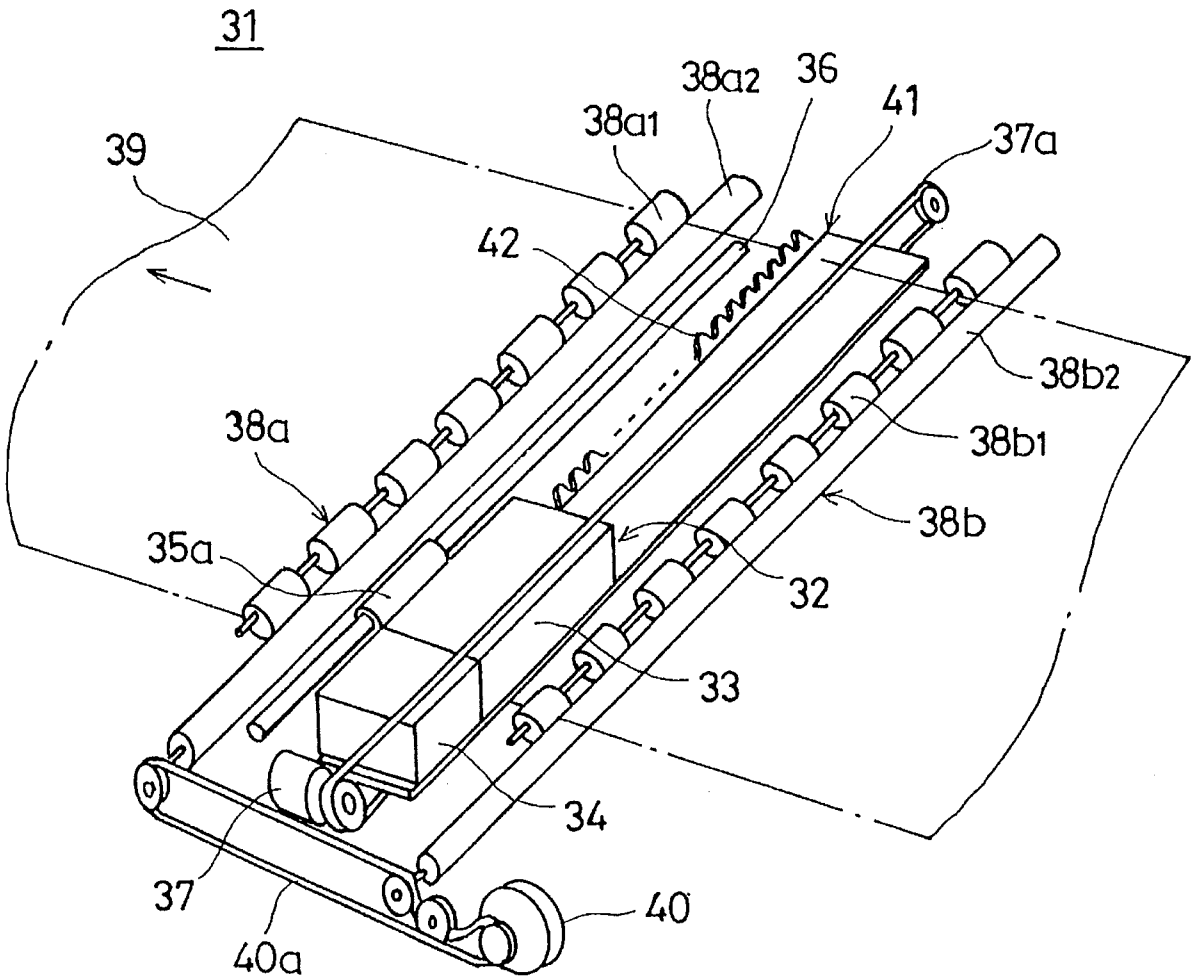
FIG. 2 is a perspective view of an electrophotographic printing machine according to a first embodiment of the present invention.
Figure 3A:
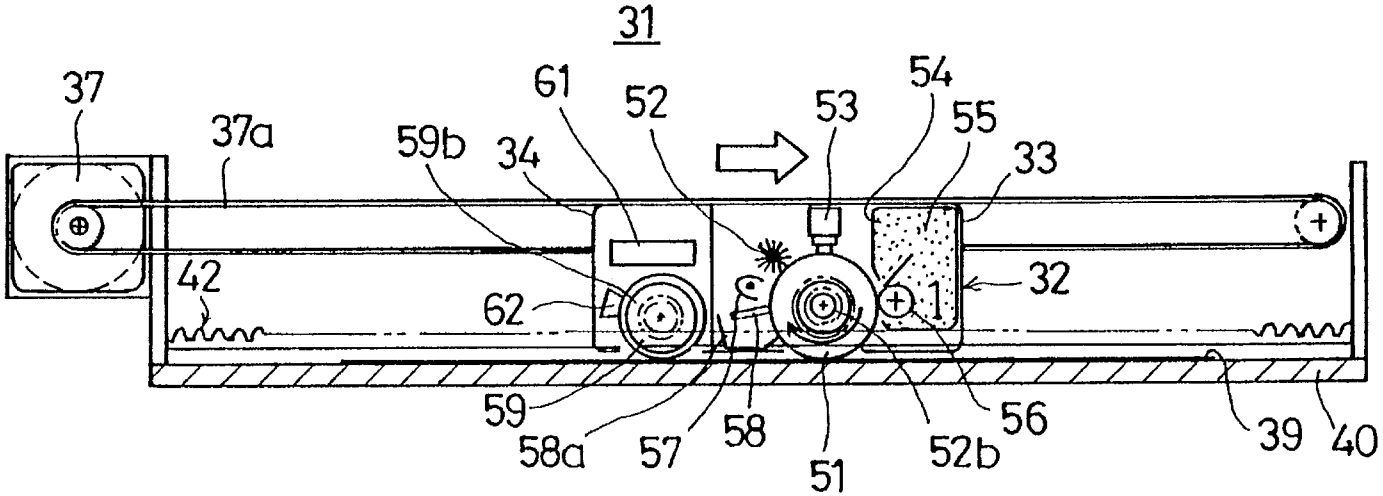
FIGS. 3A and 3B are respectively cross-sectional views of the electrophotographic printing machine shown in FIG. 2.
Figure 3B:
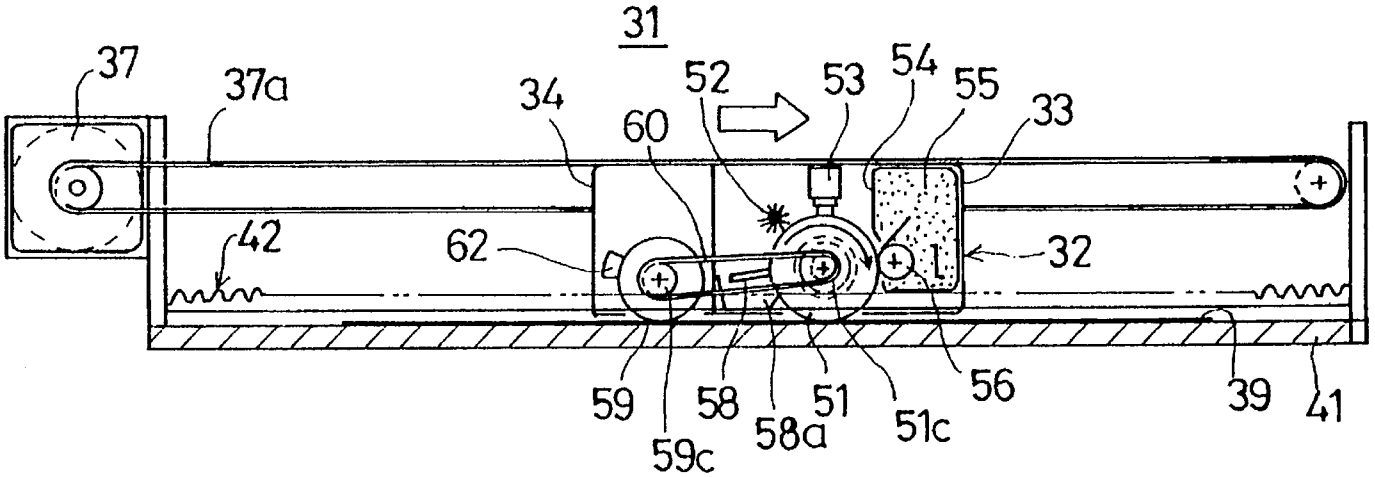

FIGS. 3A and 3B are cross-sectional view of the structure shown in FIG. 2. More particularly, FIG. 3A is a cross-sectional view on the side in which the transporting roller assembly 38*a* is provided, and FIG. 3B is a cross-sectional view on the side in which the transporting roller assembly 38*b* is provided. As described above, the carriage 32 is made up of the process unit 33 and the fixing unit 34. The process unit 33 is equipped with a recording drum 51, which is an image carrier and has a rotary shaft 51 (which does not appear in FIGS. 3A and 3B) parallel to the transporting direction of the recording paper 39. The recording drum 51 is rotated on the recording paper 39 located on the transfer unit 41. A pinion gear 51*b* engaging the rack 42 is attached to one end of the rotary shaft 51*a* located on the same side as that on which the transporting roller assembly 38*a* (FIG. 3A) is located. A pulley 51*c* is attached to the other end of the rotary shaft 51*a* located on the same side as that on which the transporting roller assembly 38*b* (FIG. 3B) is located. The pinion gear 51*b* can be freely engaged with and disengaged with the rack 42 by means of a clutch, which will be described later.

The surface of the recording drum 51 is evenly electrified by a charging unit 52, and an electrostatic latent image is formed on the surface of the recording drum 51 by means of an exposure unit 53. The electrostatic latent image is visualized as a toner image by supplying toner particles 55 filled in a developing unit 54 with the surface of the recording drum 51. The toner image formed on the recording drum 51 is transferred on the recording paper 37 by means of the transfer unit 41 facing the recording drum 51 via the recording paper 39 by applying a predetermined voltage across the transfer unit 41 and the recording drum 51.

After the fixing process, the recording drum 51 is discharged by a discharging unit 57. Thereafter, the remaining toner particles 55 are scraped away by a clear part 58*a*.

The fixing roller of the fixing unit 34 has a magnetic cylinder with a Teflon film being coated thereon. A pinion gear 59*b* is attached to one end (FIG. 3A) of the rotary shaft 59*a* (which does not appear), and a pulley 59*c* is attached to the other end (FIG. 3B) of the rotary shaft 59*a*. The pulley 51*c* of the recording drum 51 and the pulley 59*c* of the fixing roller 59 are coupled by a belt 60.

In the vicinity of the fixing roller 59, there are provided a heating unit 62 and a silicon oil coating unit 62. The heating unit 61 heats the fixing roller 59 by, for example, an induction heating process. The silicon oil coating unit 62 supplies a silicon oil to the surface of the fixing roller 59 in order to smoothly detach the toner particles 55 from the fixing roller 59.

When the carriage 32 is moved in the main scanning direction of the recording paper 39 by means of the carrier motor 37, the rack 42 and the pinion gears 51*b* and 59*b* and the recording drum 51 and the fixing roller 59 cooperating with each other by the belt 60 are rotated at a circumferential speed tuned with the movement of the carriage 32 in the direction indicated by the arrow. That is, the relative paper feeding quantity of the recording drum 51 is the same as that of the fixing roller 59.

The movement distance of the carriage 32 on the recording paper 39 depends on the module of the rack 42. The relative paper feeding quantity of the recording drum 51 depends on the outer diameter of the recording drum 51 and the diameter of an inscribed circuit of the pinion gear $51b_1$ ($51b_2$) engaging the rack 42. Hence, by providing a reduction gear (not shown for the sake of simplicity) in the carriage 32, it becomes possible to make the movement distance of the carriage 32 and the relative paper feeding quantity of the recording drum 51 equal to each other. As a result, the actually printed characters or images have a regular size to thereby prevent the characters or images from being enlarged or reduced in the main scanning direction.

The pinion gear 59*b* connected to the fixing roller 59 engages the rack 42, and the relative paper feeding quantity of the fixing roller 59 and the movement distance of the carriage 32 are made equal to each other in the same manner as the recording drum 51. The fixing roller 59 is heated and is simultaneously pressed against the recording paper 39. Since the relative paper feeding quantity of the fixing roller 59 and the movement distance of the carriage 32 are made equal to each other, it is possible to prevent the recording paper 39 sandwiched between the transporting roller assemblies 38*a* and 38*b* from being wavy during printing. As a result, images or characters can be printed at the correct positions.

The fixing roller 59 is coupled with the recording drum 51 by means of the belt 60, and is rotated in tune with the rotation of the recording drum 51. The gear ratio and the combination of the diameter of the fixing roller 59 are selected so that the relative paper feeding quantity of the fixing roller 59 is equal to the movement distance of the carriage 32. Alternatively, it is possible to couple the recording drum 51 with the fixing roller 59 by means of a combination of idler gears.

Figure 4A:
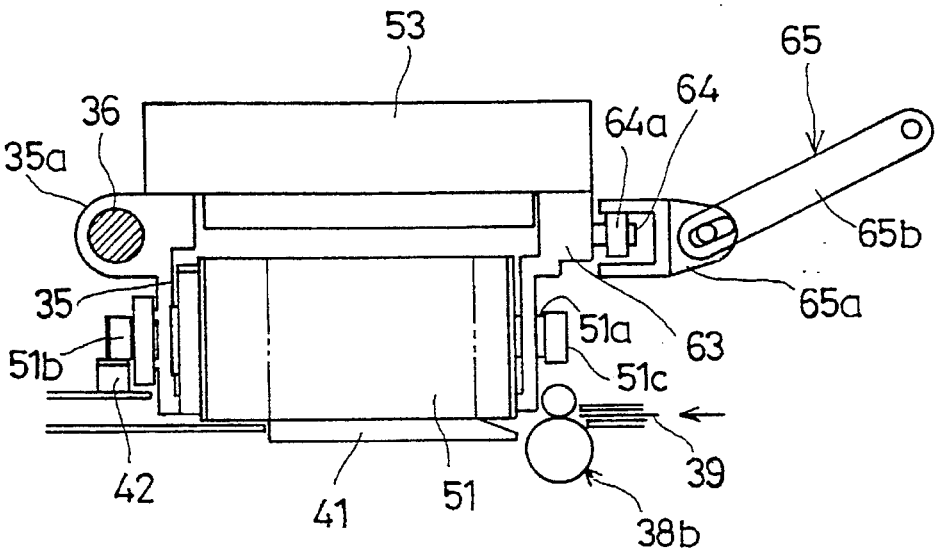
FIGS. 4A and 4B are respectively side views of a refuge mechanism employed in the first embodiment of the present invention.
Figure 4B:
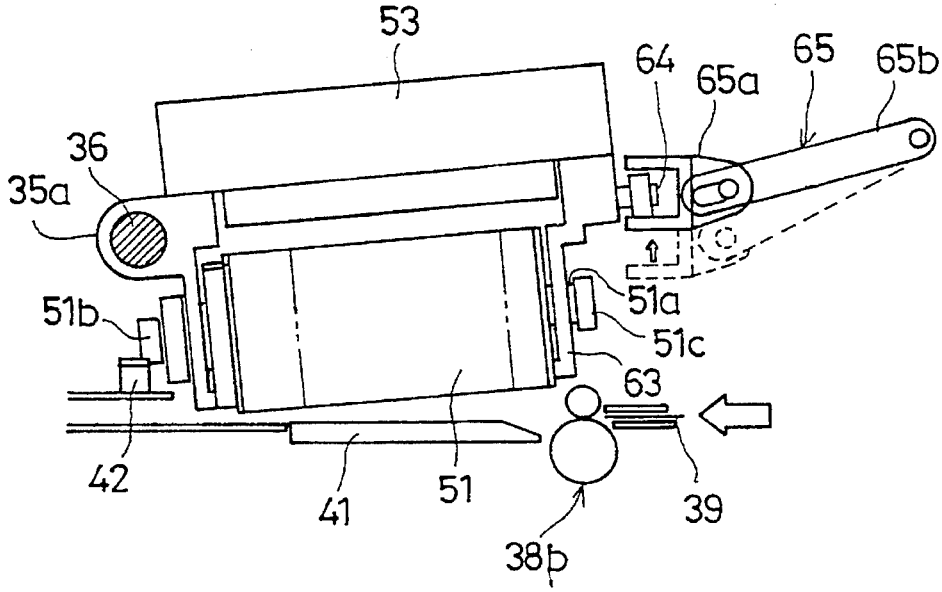

FIGS. 4A and 4B show a refuge mechanism employed in the first embodiment of the present invention. Referring to these figures, a supporting member 63 is provided on the side of the holding member 35 opposite to the side on which the guide member 35*a* is provided. The supporting member 63 is provided with an engagement member equipped with a roller 64*a*.

A refuge mechanism 65 is provided which includes a first arm 65*a* engaging the engagement member 64 and a second arm 65*b* pivotably supported by the first arm 65*a*. When the carriage 32 is moved rightward from the home position (refuge position) located at the left-end portion of FIG. 3A, the refuge mechanism 65 causes the carriage to be in the descended state, as shown in FIG. 4A. When the carriage 32 is moved toward the home position from the right-end portion and takes refuge, the refuge mechanism 65 ascends the carriage 32 about the shaft 36, as shown in FIG. 4B. During the above rightward and leftward movements, the pinion gear 51*b* is kept in engagement with the rack 42.

Figure 5A:
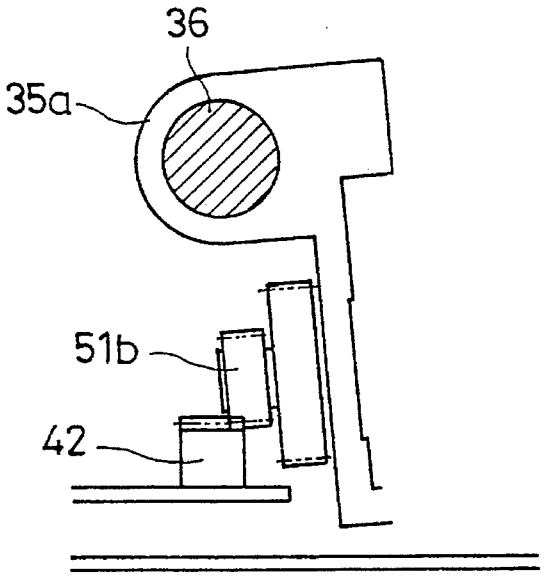
FIGS. 5A and 5B are respectively diagrams showing the operation of the refuge mechanism shown in FIGS. 4A and 4B.
Figure 5B:
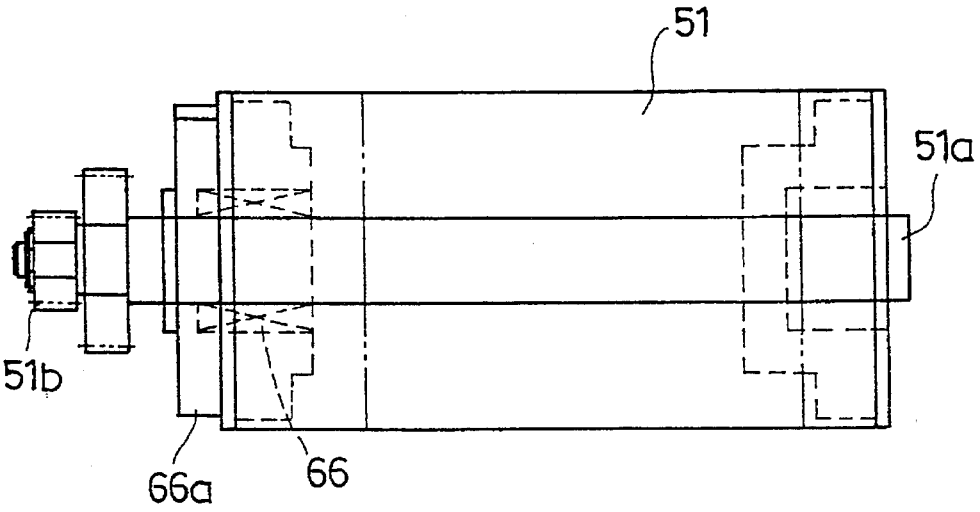

FIG. 5A shows an engagement of the pinion gear 51*b* and the rack 42 in the state shown in FIG. 4B. FIG. 5B shows that a one-directional clutch 66 is attached to a flange 66*a* inserted with pressure and fixed to one end of the recording drum 51. As shown in FIG. 5A, when the carriage 32 is obliquely ascended about the shaft 36 by means of the refuge mechanism 65 in order to take refuge the carriage 32 to the home position, the engagement of the rack 42 and the pinion gear 51*b* is kept. Hence it is possible to avoid an impact of teeth taking place when the rack and pinion gear are detached and are then brought into contact and to thus prevent a damage and positional deviation of the rack and pinion gears.

If the carriage 32 is returned to the home position in the above state, the recording drum 51 will be reversely rotated. In the process unit 33, the developing roller 56 is in contact with the recording drum 51. Hence, it is not allowed to reversely rotate the recording drum 51 taking into account the charging unit 52 and so on. With the above in mind, the one-directional clutch 66 is provided in order to inhibit the rotation of the pinion gear 51*b* from being transmitted to the recording drum 51 during the time when the carriage 32 is being returned to the home position.

Figure 6A:
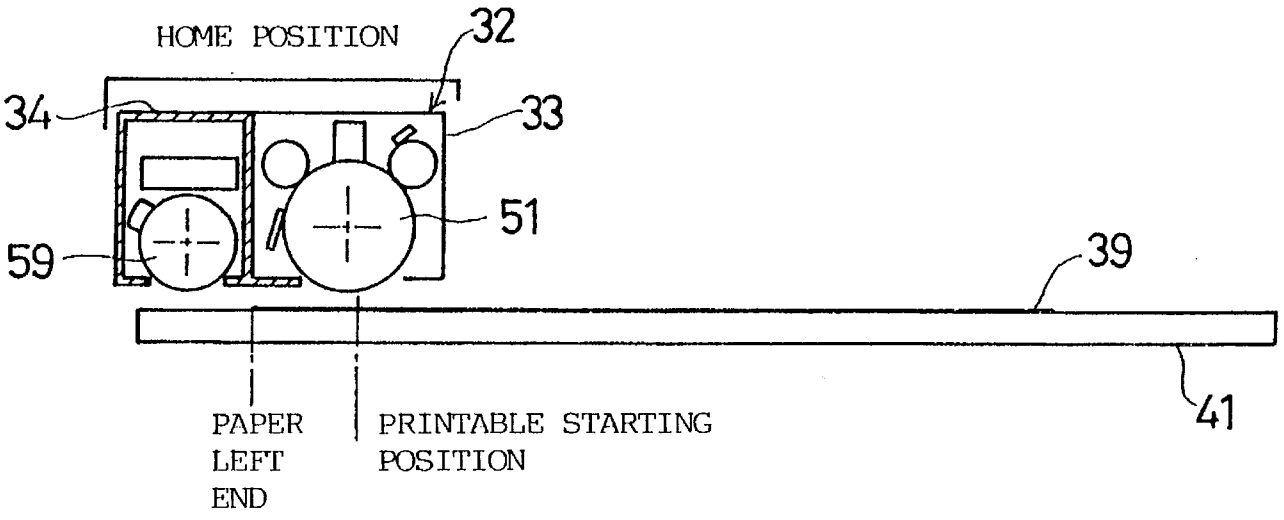
FIGS. 6A and 6B are respectively diagrams showing the operation of the first embodiment of the present invention.
Figure 6B:
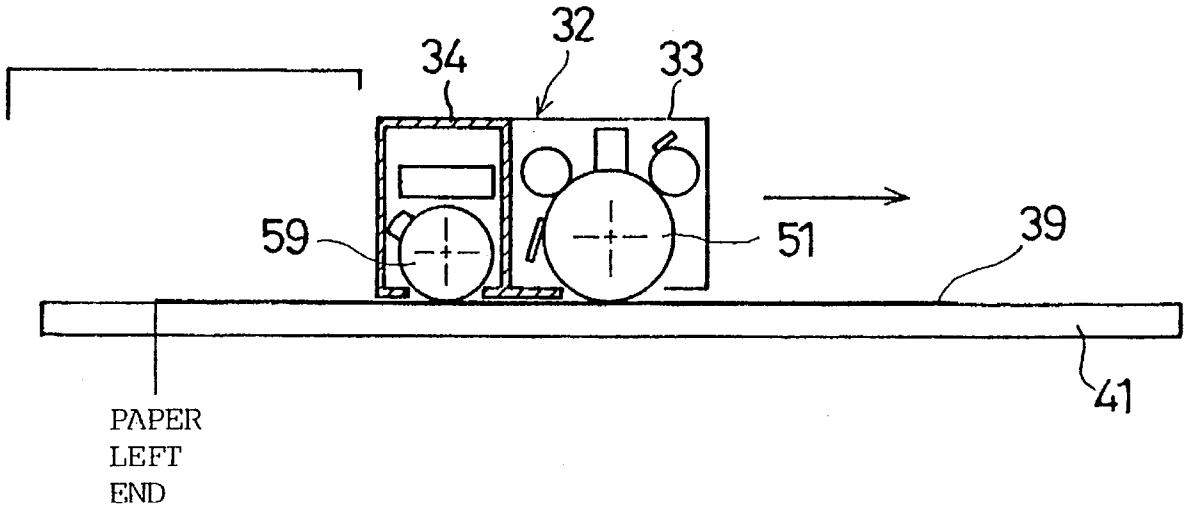
Figure 7A:
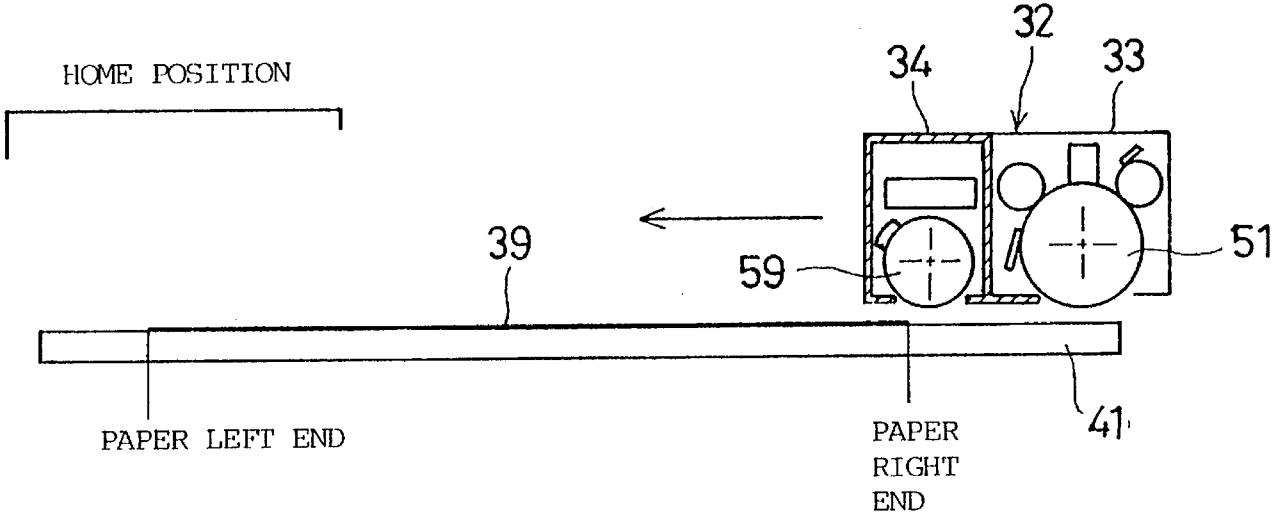
FIGS. 7A and 7B are respectively diagrams showing the operation of the first embodiment of the present invention.
Figure 7B:
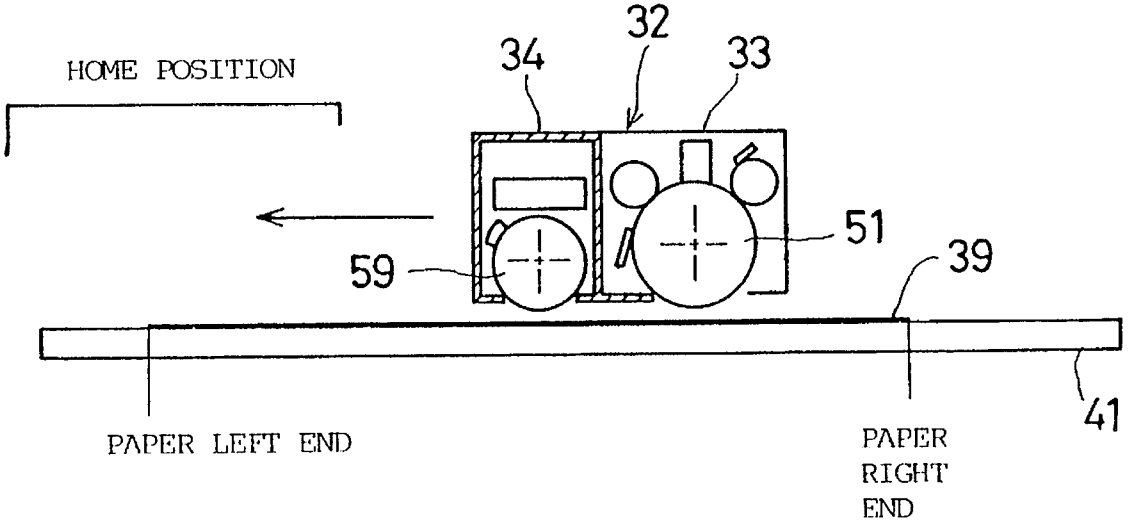

A description will now be given, with reference to FIGS. 6A, 6B, 7A and 7B, of the operation of the first embodiment of the present invention. FIGS. 6A and 6B show the printing operation which is started from the home position of the carriage 32. FIGS. 7A and 7B shows the operation performed when the carriage 32 is returned to the home position after printing. In FIGS. 6A, 6B, 7A and 7B, the mechanism for transferring the respective driving forces is omitted.

More particularly, FIG. 6A shows that the carriage 32 stands by in the home position. In other words, FIG. 6A shows the initial state after power on or the state in which the carriage 32 has been returned to the home position after the printing operation on one line is completed. The carriage 32 is held in the ascended state by means of the refuge mechanism shown in FIG. 4B and is located above the transfer unit 41. In this state, the recording drum 51 and the fixing roller 59 are located so that these parts are in non-contact with the transfer unit 42. In this case, it is enough to position the recording drum 51 approximately above the printable starting position at the left end of the recording paper 39. Hence, there is no need to provide a refuge area for the carriage 32 in the horizontal direction.

FIG. 6B shows that the carriage 32 is moved in the main scanning direction by the carrier motor 38 and the developing, transferring and fixing operations on the recording sheet 39 are performed. In these operations, the carriage 32 is kept in the descended state by means of the refuge mechanism 65 as shown in FIG. 4A. The movement of the carriage 32 rotates the pinion gears 51*b* and 59*b*, and the recording drum 51 and the fixing roller 59 are rotated at the circumferential speed tuned with the carriage 32. Further, the recording drum 51 and the fixing roller 59 rotate at the identical relative paper feeding quantity.

FIG. 7A shows that the developing, transferring and fixing operations on one line are completed and the fixing roller 59 is ascended above the right end of the recording paper 39 by means of the refuge mechanism 65. FIG. 7B shows that the carriage 32 is returning to the home position.

When the carriage 32 is returning to the home position, the pinion gears 51*b* and 59*b* are kept engaged with the rack 42. In order to prevent the reverse rotation of the recording drum 51 during the carriage returning operation, a transmission of the driving force to the recording drum 51 is released by the one-directional clutch 66. Then, as shown in FIG. 6A, the carriage 32 is returned to the home position and thereafter the rotating force of the pinion gear 51*b* is transferred to the recording drum 51 by the one-directional clutch 66.

As described above, when the carriage is moved in the main scanning direction in order to print images or characters on the recording paper 39, the recording drum 51 and the fixing roller 59 are rotated at the circumferential speed tuned with the movement of the carriage 32 by the rack and pinion method so that the recording drum 51 and the fixing roller 59 can provide the identical relative paper feeding quantity. Hence, it is possible to prevent the recording paper 39 from being wavy and to prevent deviations in the printing positions. As a result, the printing quality can be improved. There is no need to provide any motor in the carriage 32 in order to rotate the recording drum 51 and the fixing roller 59. Hence, the compact and light carriage 32 can be provided. Further, a degradation of the printing quality due to force of inertia can be prevented because the carriage 32 is compact and light. Furthermore, it is possible to prevent the recording drum 51 from being damaged because the carriage 32 is ascended by the refuge mechanism 65 so as not to make contact with the recording paper 39 when returning it to the home position. Hence, the printing quality can be further improved.

Figure 8A:
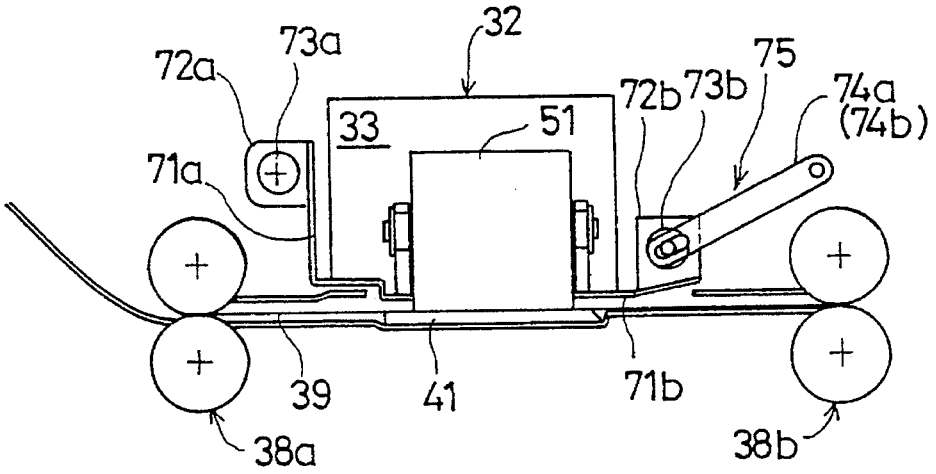
FIGS. 8A and 8B are respectively side views of a refuge mechanism employed in an electrophotographic printing machine according to a second embodiment of the present invention.
Figure 8B:
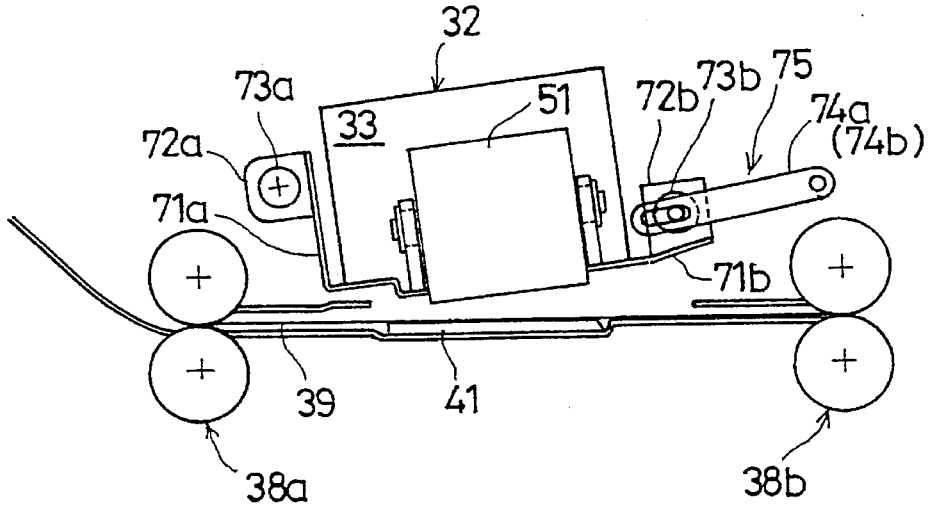

FIGS. 8A and 8B show a refuge mechanism of an electrophotographic printing machine according to a second embodiment of the present invention. The carriage 32 shown in FIGS. 8A and 8B is held by holding members 71 and 71*b* to which guide members 72*a* and 72*b* are respectively attached. Shafts 73 and 73*b* penetrate the guide members 72*a* and 72*b*, respectively. A refuge mechanism 75 includes levers 74*a* and 74*b* (lever 74*b* does not appear) equipped with springs (which do not appear) attached to two ends of the shaft 73*b*. The other parts shown in FIGS. 8A and 8B are the same as those of the first embodiment of the present invention.

The refuge mechanism 75 is operated by positioning the carriage 32 by the shaft 73*b* and the associated spring. As shown in FIG. 8A, the recording drum 51 is in contact with the recording paper 39 in the state in which the carriage 32 is descended. The developing, transferring and fixing operations are performed in the main scanning direction. After the print is completed, the carriage 32 is returned to the home position. At this time, the refuge mechanism 75 pivots the levers 74*a* and 74*b* to ascend the carriage 32 about the shaft 73*a* so that the recording drum 51 is detached from the recording paper 39.

Figure 9A:
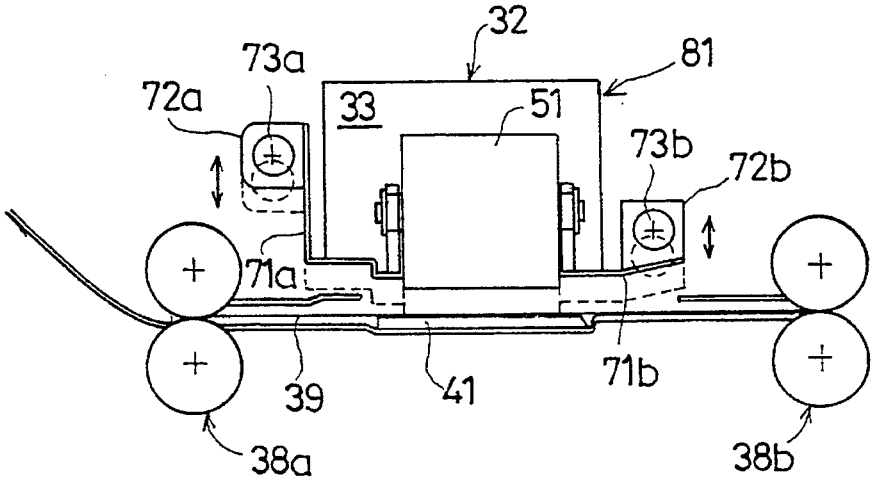
FIG. 9A is a side view of a variation of the refuge mechanism shown in FIGS. 8A and 8B.
Figure 9B:
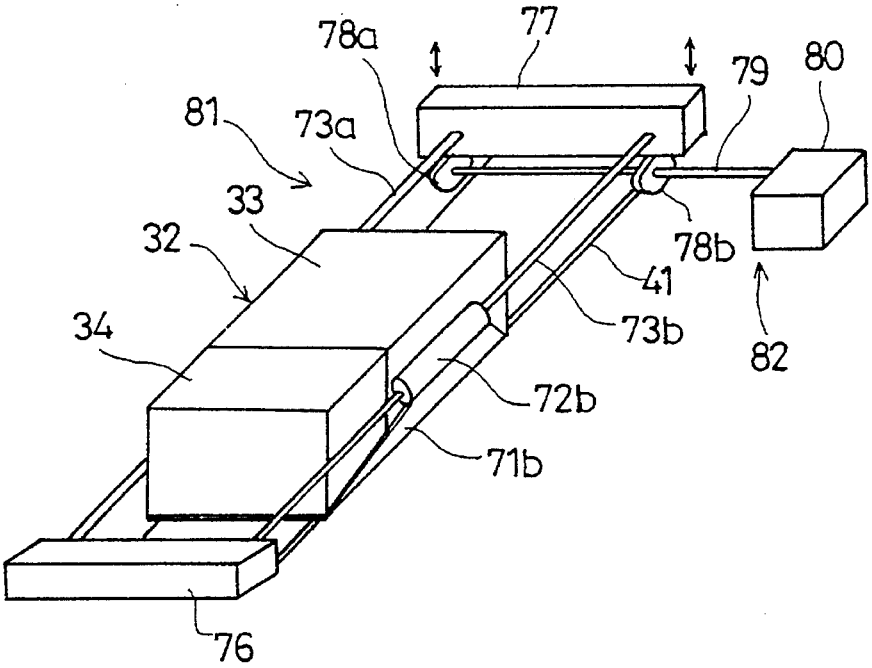
FIG. 9B is a perspective view of the variation shown in FIG. 9A.

FIGS. 9A and 9B show a variation of the refuge mechanism shown in FIGS. 8A and 8B. FIG. 9A is a cross-sectional view of the variation, and FIG. 9B is a perspective view thereof. Referring to FIG. 9A, the shafts 73*a* and 73*b* penetrate the guide members 72*a* and 72*b* formed in the holding members 71*a* and 71*b* of the carriage 32. One-ends of the shafts 73*a* and 73*b* are fixed to a fixing part 76, and the other ends thereof are fixed to a movable part 77.

As shown in FIG. 9B, oval pulleys 78*a* and 78*b* are disposed below the movable part 75. The oval pulleys 78*a* and 78*b* are rotated by a moving mechanism 80 via a shaft 79. The carriage 32, the shafts 73*a* and 73*b* and the movable part 77 form a guide shaft 81, and the oval pulleys 78*a*, 78*b*, the shaft 79 and the moving mechanism 80 form a refuge mechanism 82. The transporting roller assemblies 38*a* and 38*b* and the transfer unit 41 are stationary units.

In the refuge mechanism 82, the oval pulleys 78*a* and 78*b* are rotated by driving the moving mechanism 80, so that the movable 77 moves upward or downward. When the movable part 77 is in the down state at the rotating positions of the oval pulleys 78*a* and 78*b* during printing, the carriage 32 is in the descended state and the recording drum 51 is in contact with the recording paper 39. When the carriage 32 takes refuge, the movable part 77 is ascended by the oval pulleys 78*a* and 78*b*. Hence, the carriage 32 is ascended and the recording drum 51 is detached from the recording paper 39.

According to the present invention, it is possible to provide a compact carriage and improve the printing quality by avoiding occurrence of a wavy state of the recording paper by rotating the image carrier and the fixing member at the identical relative paper feeding quantity by means of the driving means arranged outside of the carriage. Further, it is possible to prevent the image carrier from being damaged and improve the printing quality by ascending the carriage from the recording paper when the carriage is returned to the home position.

The present invention is not limited to the specifically disclosed embodiments, and variations and modifications may be made without departing from the scope of the present invention.

What is claimed is:

1. An electrophotographic printing machine comprising:

transporting means for transporting a recording medium;

a carriage movable in a first direction transverse to a second direction in which the recording medium is transported, said carriage comprising process means for forming a latent image on an image carrier of a drum shape, and fixing means having a fixing member of a drum shape for thermally fixing a transferred image corresponding to the latent image on the recording medium;

transfer means, provided at a first side of the recording medium opposite to a second side thereof at which the carriage is located, for transferring the latent image on the recording medium to thereby form said transferred image;

moving means for moving the carriage in the first direction; and driving means for controlling the carriage so that the image carrier and the fixing member move at an identical relative paper feeding quantity in tune with a movement of the carriage by the moving means.

2. The electrophotographic printing machine as claimed in claim 1, wherein said driving means comprises:

a pinion gear provided to a shaft of the fixing member; and a rack of a linear type which engages the pinion gear and is kept stationary.

3. The electrophotographic printing machine as claimed in claim 2, wherein said driving means comprises a coupling member coupling the shaft of the fixing member and a shaft of the image carrier so that the image carrier and the fixing member move at the identical relative paper feeding quantity.

4. The electrophotographic printing machine as claimed in claim 2, wherein said driving means comprises:

another pinion gear provided to a shaft of the image carrier; and a coupling member coupling the shaft of the fixing member and a shaft of the image carrier so that the image carrier and the fixing member move at the identical relative paper feeding quantity.

5. The electrophotographic printing machine as claimed in claim 1, wherein said driving means comprises:

a first pinion gear provided to a shaft of the fixing member;

a second pinion gear provided to a shaft of the image carrier;

a rack of a linear type which engages the first and second pinion gears and is kept stationary; and a coupling member for coupling the shaft of the fixing member and the shaft of the image carrier.

6. The electrophotographic printing machine as claimed in claim 1, further comprising refuge mechanism means for detaching the carriage from the recording medium when the carriage is returned to a home position.

7. The electrophotographic printing machine as claimed in claim 6, wherein said refuge mechanism means comprises means for making the carriage pivot about a guide shaft along which the carriage is moved in the first direction by the moving means.

8. The electrophotographic printing machine as claimed in claim 6, wherein said refuge mechanism means comprises means for moving, when the carriage is returned to the home position, a guide shaft along which the carriage is moved in the first direction by the moving means so that the carriage can be detached from the recording medium due to a movement of the guide shaft.

9. The electrophotographic printing machine as claimed in claim 6, further comprising means for preventing the image carrier from rotating when the carriage is returned to the home position.

10. The electrophotographic printing machine as claimed in claim 5, further comprising refuge mechanism means for detaching the carriage from the recording medium when the carriage is returned to a home position.

11. The electrophotographic printing machine as claimed in claim 10, wherein said refuge mechanism means detaches the carriage from the recording medium in a state where the first and second pinion gears engage the rack.

12. The electrophotographic printing machine as claimed in claim 10, wherein said refuge mechanism means comprises means for making the carriage pivot about a guide shaft along which the carriage is moved in the first direction by the moving means.

13. The electrophotographic printing machine as claimed in claim 10, wherein said refuge mechanism means comprises means for moving, when the carriage is returned to the home position, a guide shaft along which the carriage is moved in the first direction by the moving means so that the carriage can be detached from the recording medium due to a movement of the guide shaft.

14. The electrophotographic printing machine as claimed in claim 10, further comprising means for preventing the image carrier from rotating when the carriage is returned to the home position.

15. An electrophotographic printing machine comprising:

transporting means for transporting a recording medium;

a carriage movable in a first direction transverse to a second direction in which the recording medium is transported, said carriage comprising process means for forming a latent image on an image carrier of a drum shape, and fixing means having a fixing member of a drum shape for thermally fixing a transferred image corresponding to the latent image on the recording medium;

transfer means, provided at a first side of the recording medium opposite to a second side thereof at which the carriage is located, for transferring the latent image on the recording medium to thereby form said transferred image;

moving means for moving the carriage in the first direction; and refuge mechanism means for detaching the carriage from the recording medium when the carriage is returned to a home position.

* * * * *